US008967896B2

(12) United States Patent
Johnson et al.

(10) Patent No.: US 8,967,896 B2
(45) Date of Patent: Mar. 3, 2015

(54) COSMETIC APPARATUS AND METHOD

(71) Applicants: Dean Johnson, Calabasas, CA (US); Jennifer Baker-Johnson, Calabasas, CA (US); Robyn M. Rhodes, Studio City, CA (US)

(72) Inventors: Dean Johnson, Calabasas, CA (US); Jennifer Baker-Johnson, Calabasas, CA (US); Robyn M. Rhodes, Studio City, CA (US)

( * ) Notice: Subject to any disclaimer, the term of this patent is extended or adjusted under 35 U.S.C. 154(b) by 268 days.

(21) Appl. No.: 13/682,517

(22) Filed: Nov. 20, 2012

(65) Prior Publication Data

US 2013/0129402 A1 May 23, 2013

Related U.S. Application Data

(60) Provisional application No. 61/563,476, filed on Nov. 23, 2011.

(51) Int. Cl.

| | |
|---|---|
| ***A45D 33/00*** | (2006.01) |
| ***A45D 40/26*** | (2006.01) |
| *A45D 33/22* | (2006.01) |

(52) U.S. Cl.

CPC ..... *A45D 40/267* (2013.01); *A45D 33/22* (2013.01)

USPC ..... 401/130; 401/129; 401/126; 401/122

(58) Field of Classification Search

USPC ..... 401/121, 122, 126–130, 16

See application file for complete search history.

(56) References Cited

U.S. PATENT DOCUMENTS

| | | | | |
|---|---|---|---|---|
| 2,691,184 | A | | 10/1954 | Miller |
| 3,085,281 | A | | 4/1963 | Massman |
| 4,705,053 | A | | 11/1987 | Goncalves |
| 4,886,080 | A | * | 12/1989 | Cole ..... 132/320 |
| 4,972,858 | A | | 11/1990 | Beck et al. |
| 4,984,918 | A | | 1/1991 | Iizuka et al. |
| 5,180,241 | A | | 1/1993 | Gueret |
| 5,794,632 | A | | 8/1998 | Gueret |
| D422,748 | S | | 4/2000 | Lang |
| 6,059,474 | A | | 5/2000 | Huang |
| 6,276,856 | B1 | | 8/2001 | Pieper et al. |
| 6,325,561 | B1 | | 12/2001 | Reynolds |
| 6,637,963 | B2 | | 10/2003 | Huang |
| 7,325,993 | B2 | | 2/2008 | Gueret |
| 2008/0000494 | A1 | | 1/2008 | Sek |
| 2012/0027497 | A1 | | 2/2012 | Huang |

* cited by examiner

*Primary Examiner* — David Walczak
(74) *Attorney, Agent, or Firm* — Kelly & Kelley, LLP

(57) ABSTRACT

A cosmetic apparatus includes a double-ended cosmetic container having a liquid cosmetic reservoir chamber therein. Interchangeable end caps are removably attached to generally opposite ends of the container. An applicator wand, attached to the first end cap, is insertable through the first end and a first wiper insert, and selectively moved to the generally opposite second end so as to be insertable through the second open end and second insert, which is configured to funnel cosmetic material into the second insert and onto the applicator so as to capture the remaining cosmetic material.

34 Claims, 5 Drawing Sheets

COSMETIC APPARATUS AND METHOD

BACKGROUND OF THE INVENTION

The present invention generally relates to cosmetic containers. More particularly, the present invention resides in an improved cosmetic apparatus which is a double-ended container and configured to facilitate the removal of the cosmetic liquid material within the container.

There exist several types of cosmetic containers which contain a liquid cosmetic material which is removed from the container via an applicator wand for application to the various parts of the body of the individual. For example, a conventional mascara applicator comprises a mascara container and a removable cap which is adapted to close the container and which forms a handle for the manipulation of an applicator wand. Typically, the applicator wand comprises a rod attached to or formed integrally with the cap and having a brush at the end thereof. In the closed position of the container, the rod and brush associated therewith are dipped into the container. When the rod is removed from the container, a certain quantity of mascara is taken up on the brush and can then be applied to the eyelashes. Similar steps are taken with respect to lip gloss, concealer, and similar cosmetic products.

Current cosmetic technology does not allow for maximum use of the cosmetic product. In the existing technology, the end of the applicator wand defining the brush, sponge material, etc. which is to be loaded with the liquid cosmetic material does not reach the bottom of the container. If it did, it could bend, break, or otherwise damage the bristles, brush, sponge material, etc. of the wand. Thus, the user is not able to remove cosmetic product residing at the bottom of the container. This currently results in the user throwing away a container which still has cosmetic material therein, which is wasteful and costly.

Accordingly, there is a continuing need for a cosmetic container which enables the capture of all, or nearly all, of the liquid cosmetic material therein. The present invention fulfills these needs, and provides other related advantages.

SUMMARY OF THE INVENTION

The present invention resides in a cosmetic apparatus comprising a double-ended cosmetic container and a related method of removing all, or nearly all, of the liquid cosmetic material within the container, overcoming the shortcomings of the existing technology.

The cosmetic container generally comprises an elongated body defining a single internal chamber for storing liquid cosmetic material between a first open end and a second generally opposite open end. The single chamber is accessible from either the first open end or the second open end. A first cap is removable attachable to either the first or second open end of the body. Similarly, a second cap is removably attachable to either the first or second end of the body, such that the first and second caps are interchangeable. Typically, the body adjacent to the first and second open ends includes external threads, and the first and second caps include mating internal threads.

An applicator wand extends into the chamber from either the first or second open end of the body. The applicator wand is adapted to remove liquid cosmetic material from the chamber. The chamber is typically an elongated tubular configuration of a length greater than a length of the applicator wand disposable in the chamber. Preferably, the first cap is attached to an end of the applicator wand, or formed integrally therewith, and serves as a handle for the applicator wand. The container includes only a single applicator wand and the second cap is not attached to the applicator wand. Typically, the first cap, which serves as a handle for the applicator wand, has a greater length than the second cap. An end of the applicator wand distal the first cap includes a liquid cosmetic capturing material, such as a brush or sponge material.

A first insert is disposed within the first open end of the body. The first insert is adapted to permit the applicator wand to slidably extend therethrough and scrape excess cosmetic material therefrom when removed from the body. The first insert is a generally hollow cylindrical member and includes a first aperture proximal the first opening and a wiper lip for scraping excess cosmetic material from the applicator wand. A second aperture of the first insert distal the first opening of the body typically defines the wiper lip.

A second insert is disposed within the second open end of the body. The second insert is adapted to permit the applicator wand to slidably extend therethrough and scrape excess cosmetic material therefrom when removed from the body. The second insert is a generally hollow cylindrical member and includes a wiper lip for scraping excess cosmetic material from the applicator wand. An end of the second insert is configured to funnel cosmetic material from the chamber into the second insert when the second end of the container is directed downwardly. The wiper lip of the second insert is defined by a first aperture of the second insert. The end of the second insert is configured to funnel cosmetic material and is defined by a second aperture of a larger diameter than the first aperture, and is disposed adjacent to or within the chamber.

After capturing as much of the cosmetic material through the first end and insert of the container as possible, the applicator wand and attached first end cap are removed and the second end cap is removed. The first end cap and the applicator wand are then inserted through the second open end and second insert of the container, while the second end cap is attached to the opposite first end of the body of the container. The funneling configuration of the second insert allows the applicator wand to capture much of, if not all of, the remaining cosmetic material left in the chamber of the container.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

As shown in the accompanying drawings, for purposes of illustration, the present invention is directed to a cosmetic apparatus, including a double-ended container, and method of use. In accordance with the present invention, the double-ended cosmetic apparatus enables a user to remove all, or nearly all, of the liquid cosmetic material within the cosmetic container apparatus, unlike existing cosmetic containers for lip gloss, mascara, eyeliner, and the like.

Figure 1:
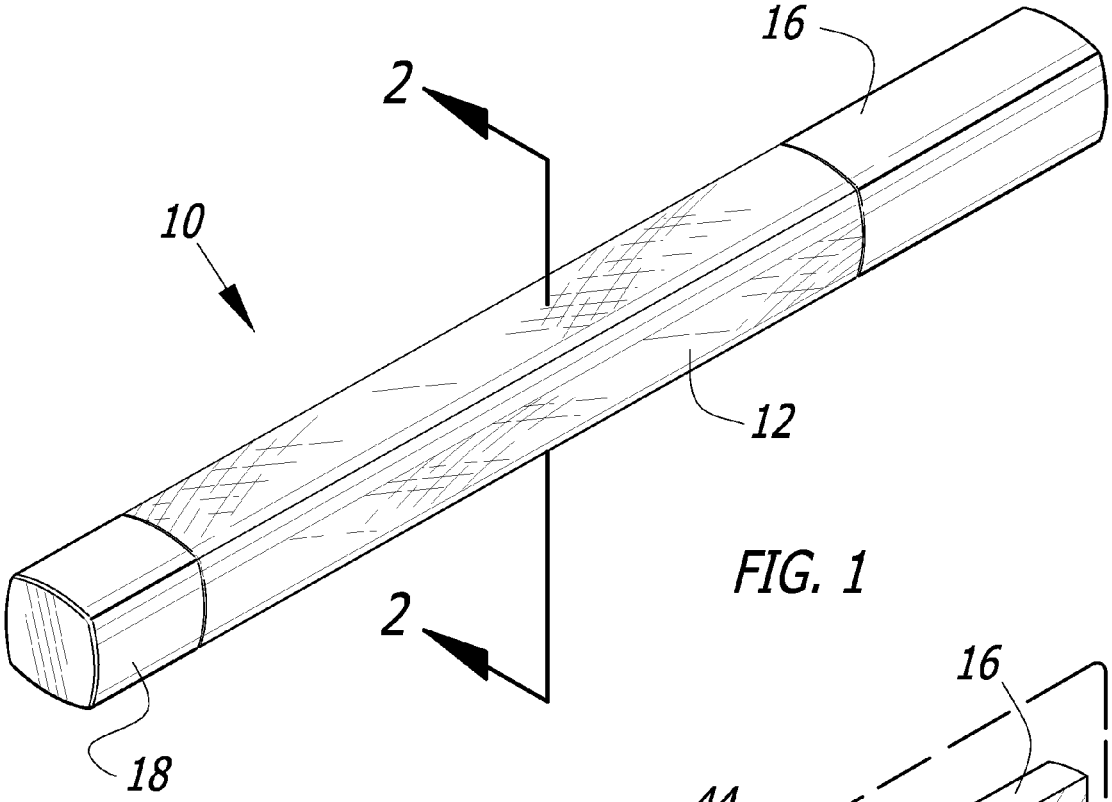
FIG. 1 is a perspective view of a cosmetic apparatus embodying the present invention.

With reference now to FIG. 1, a double-ended cosmetic container apparatus, generally referred to by the reference number 10, embodying the present invention is shown in a closed state. The container 10 comprises a body 12 defining a single chamber 14 therein adapted to act as a reservoir and store liquid cosmetic material therein. A first end cap 16 is attached to one end of the body 12 and a second end cap 18 is removably attached to a generally opposite second end of the body 12. In the prior art, the containers typically only have a single end cap and a single open end of the container, with the other end of the container being closed.

Figure 2:
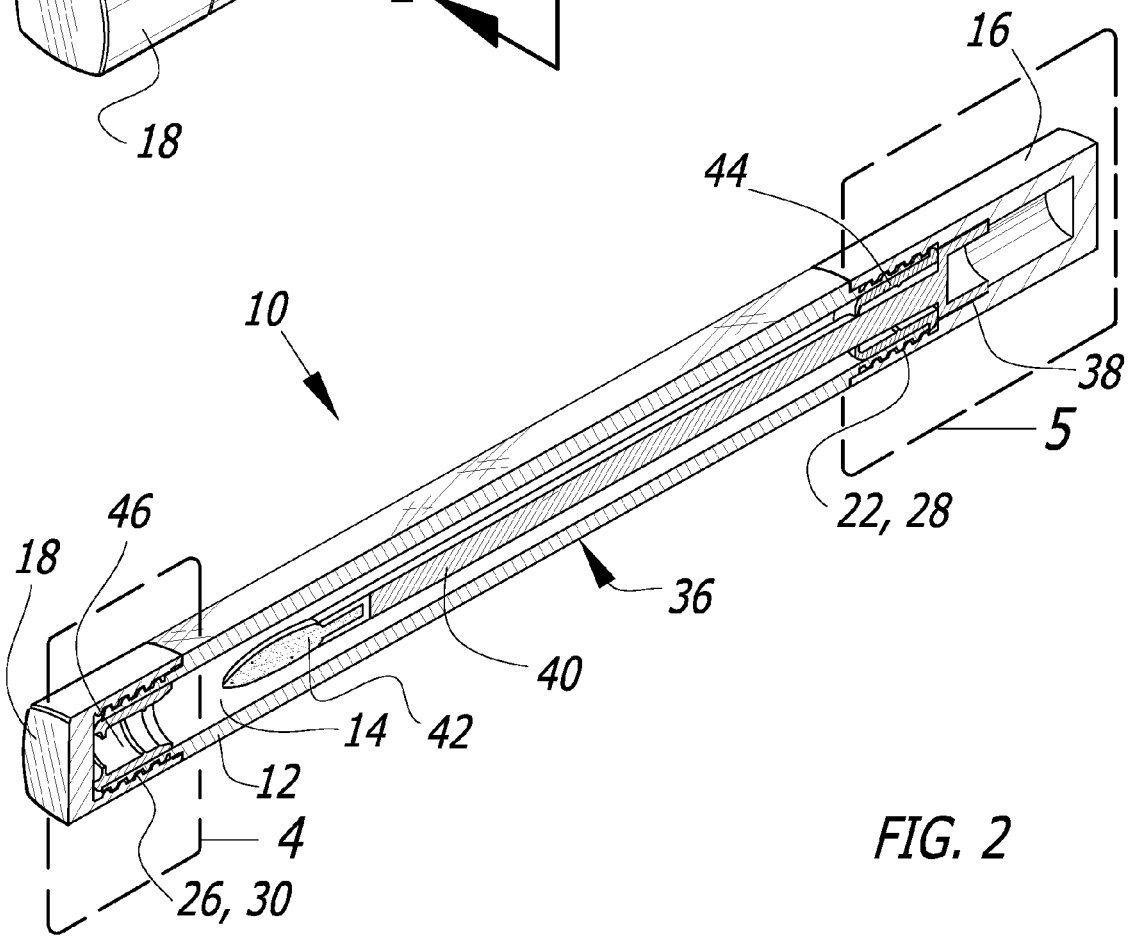
FIG. 2 is a cross-sectional view taken generally along line 2-2 of FIG. 1, illustrating the component parts thereof.
Figure 3:
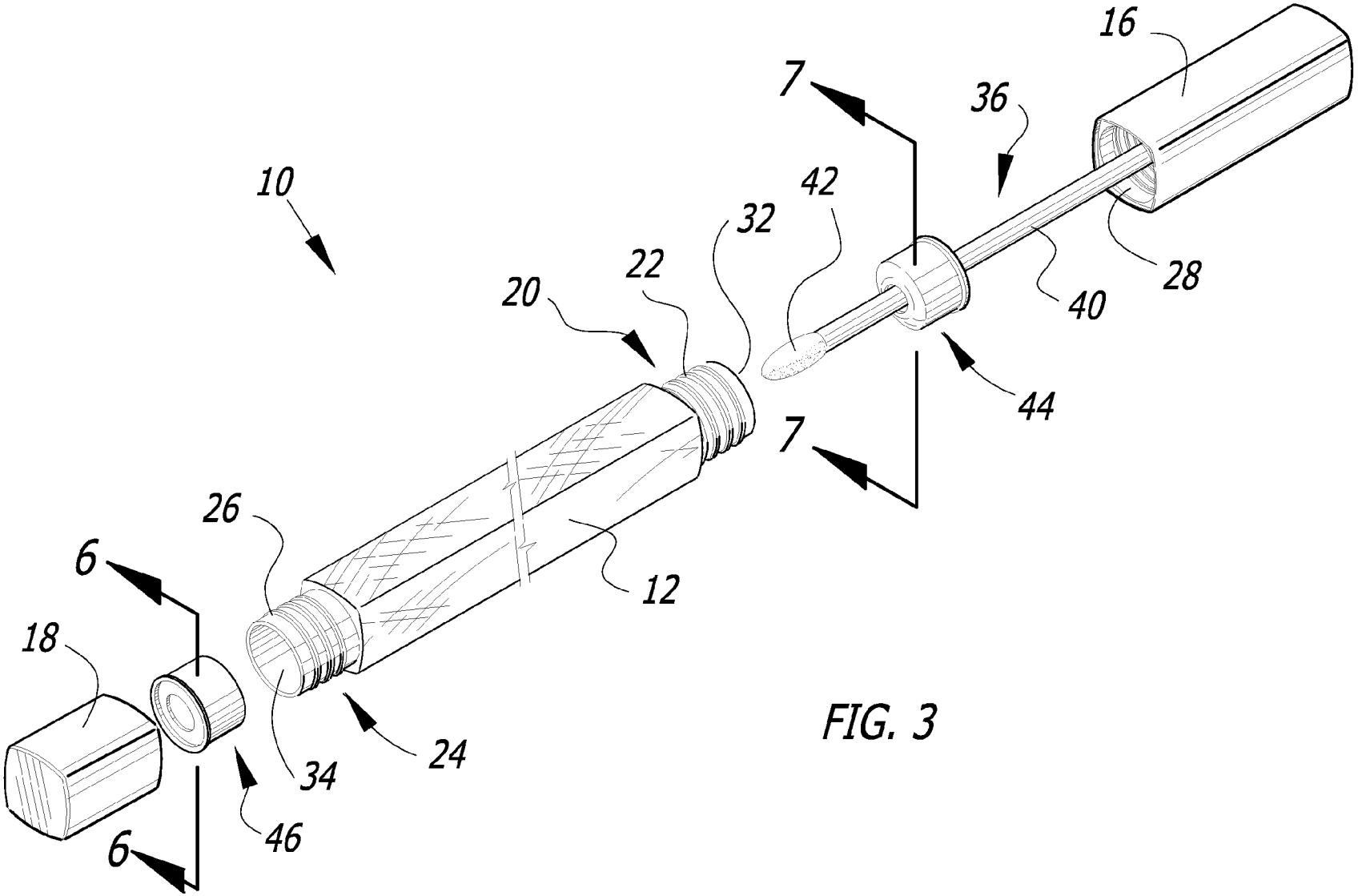
FIG. 3 is an exploded perspective view of the components of the cosmetic apparatus.

With reference now to FIGS. 2 and 3, in the illustrated embodiment, as shown in FIG. 2, the body 12 is elongated, so as to define an elongated chamber 14. It will be appreciated that the body 12 can be comprised of any suitable material, typically plastic, but other materials such as glass, metal, etc. can be utilized. Moreover, the outer shape of the body 12 can have a different configuration than the inner chamber 14. For example, as shown in FIG. 1, the outer surface of the body 12 is multi-faceted, whereas the chamber 14 comprises a single elongated tubular structure.

With continuing reference to FIGS. 2 and 3, the end caps 16 and 18 are removably attached to the body. In fact, the end caps 16 and 18 are interchangeable with respect to the end of the body 12 to which they are attached, as will be more fully described herein. In one embodiment, the first end of the body 20 has external threads 22, and the generally opposite second end of the body 24 also includes similar exterior threads 26. The first end cap 16 includes mating threads 28, and the second end cap 18 also includes mating threads 30. Typically, these threads 28 and 30 are formed in an interior portion of the end of the cap 16 and 18, as illustrated in FIG. 2. Although the invention is illustrated as having a removable threaded connection between the end caps 16 and 18 and the ends 20 and 24 of the body 12 it will be understood that other removable connection means is possible, such as by snap friction fit or any other known removable connection means. The important aspect, in accordance with the present invention, is that either end cap 16 or 18 can be removably attached to either end 20 or 24 of the body 12.

A particularly preferred embodiment is illustrated herein, wherein the ends 20 and 24 of the body 12 are of a reduced outer diameter than the central portion of the body 12, such that when the first and second caps 16 and 18 are attached thereto, the outer surface configuration of the body 12 and the end caps 16 and 18 is generally uniform, as illustrated in FIG. 1. Although this is aesthetically appealing, it will be appreciated that the body 12 and the end caps 16 and 18 can have varying configurations. However, the inner chamber 14 of the body 12 is a single chamber which is accessible through the first open end 32 and second open end 34, generally opposite the first open end 32 of the body and chamber 12 and 14.

With continuing reference to FIGS. 2 and 3, the apparatus 10 of the present invention also includes an applicator wand 36 which is configured to extend into the chamber 14 from either the first or second open end 32 or 34 of the body 12, and controllably remove liquid cosmetic material from the chamber 14. Typically, the applicator wand 36 has a first end 38 which is attached to, or formed integrally with, the first end cap 16. Such attachment can be by any known means. The applicator wand includes a rod 40 which extends between the first end 38 and a second end 42 which defines a liquid cosmetic capturing material or arrangement. It will be appreciated by those skilled in the art that the second end defining the cosmetic capturing material 42 can comprise varying configurations and materials. For example, the second end 42 may comprise a plurality of bristles, one end of the bristles being attached to the rod 40 with the other end of the bristles being free. The bristles may be in the form of a brush head, such as extending from a plastic or wire loop or the like. Alternatively, the end 42 may comprise a sponge material for capturing the liquid cosmetic. Any material or arrangement which serves to capture the liquid cosmetic material and apply it as needed is contemplated by the invention.

As shown in FIG. 2, the applicator wand 36 is of such a length that the length thereof within the inner chamber 14 is less than the length of the inner chamber 14, such that the free cosmetic capturing end 42 does not extend to the end of the chamber 14 and body 12, but instead there is a gap or space between the end of the chamber and/or body 12 and the tip of the applicator wand 36. As discussed above, this is desirable so as not to bend, break, or otherwise damage the liquid cosmetic capturing end 42 of the applicator wand 36.

As shown in FIGS. 2 and 3, the apparatus 10 of the present invention includes a first insert 44 disposed within the open end 32 of the body 12 and a second insert disposed within the second open end 34 of the body 12. Both the first and second inserts 44 and 46 are configured to permit the applicator wand 36 to be inserted therethrough, and scrape excess cosmetic material from the applicator wand 36 when it is removed from the body 12. However, the inserts 44 and 46 have different configurations which serve different purposes, as will be explained herein.

Figure 5:
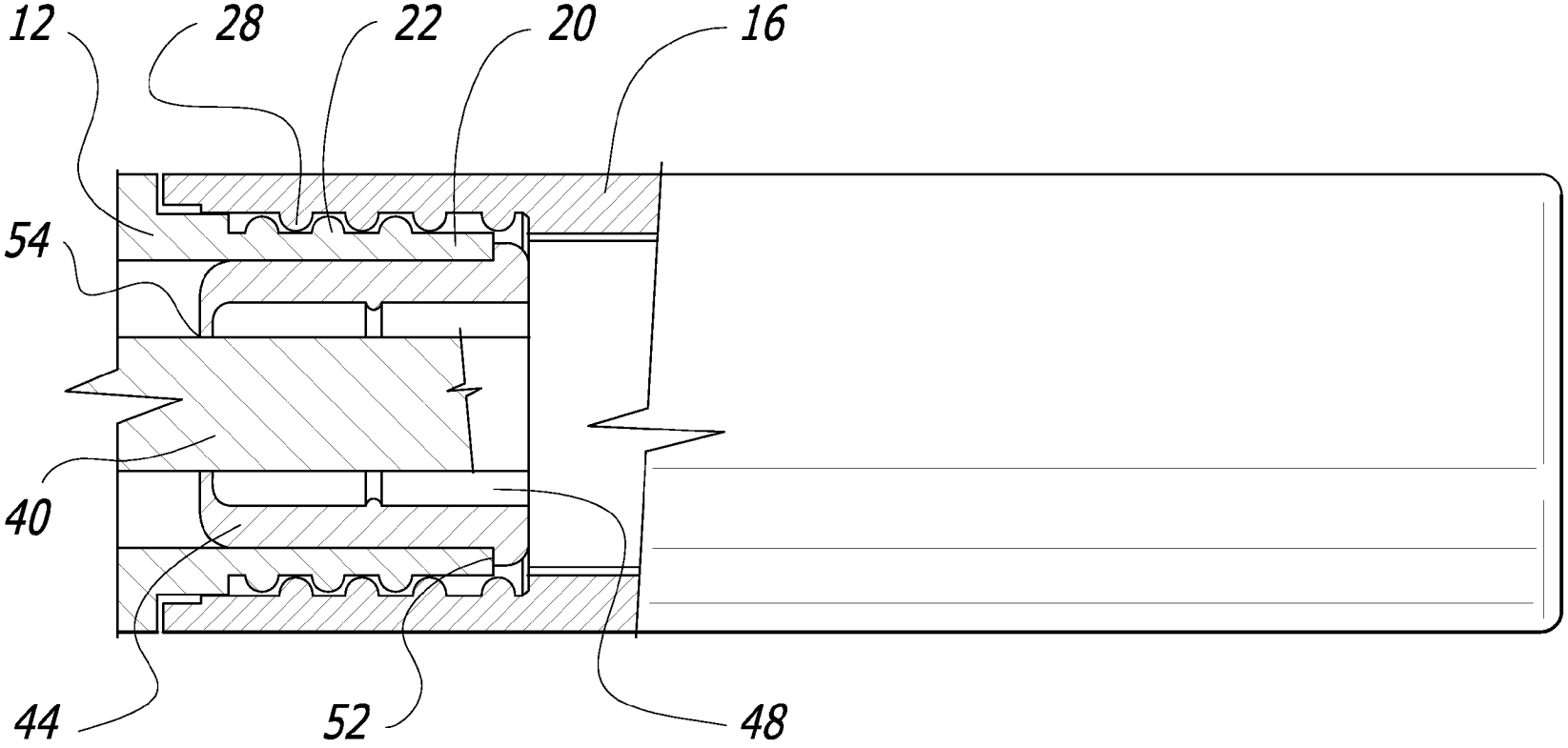
FIG. 5 is an enlarged partially sectioned view of area "5" of FIG. 2.
Figure 7:
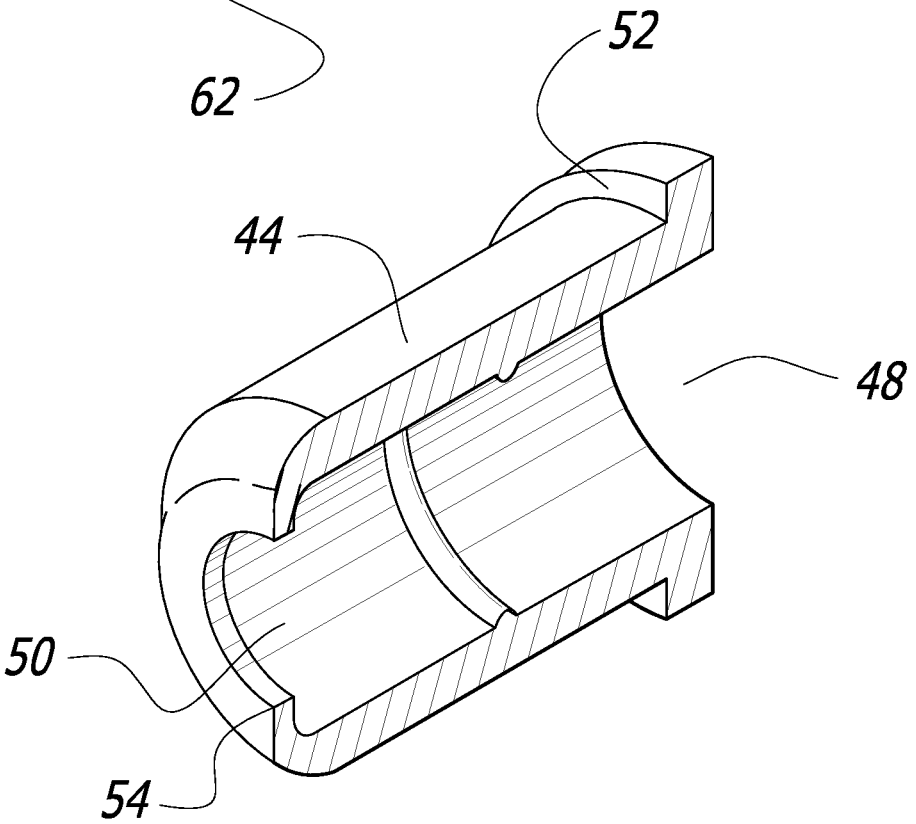
FIG. 7 is a sectioned perspective view of a first insert, taken generally along line 7-7 of FIG. 3, used in the cosmetic apparatus of the present invention.

With reference now to FIGS. 5 and 7, the first insert 44 is generally configured as a hollow cylindrical member, having a first open end 48 and a generally opposite second open end 50. The first open end 48 typically seats adjacent to the open end 32 and first end 20 of the body 12 of the container. As such, a ledge 52 is formed in the first insert 44 for engaging the first end 20 of the body 12. The remainder of the first insert 44 has an outer diameter which is generally equal to or slightly less than an inner diameter of the first end 20 of the container 12 and/or inner chamber 14, so as to reside therein, as illustrated in FIG. 5.

With continuing reference to FIG. 5, it can be seen that the rod 40 of the applicator wand 36 extends through the first opening 48 of the insert 44 and also through the second opening 50 of the insert 44. In this embodiment, an inwardly directed flange 54 defines the second aperture 50, making it of a reduced and smaller diameter than that of the first aperture 48. The flange 54 acts as a wiper lip such that as the applicator wand 36 is removed from the body 12, the end 42 of the applicator wand which captures the liquid cosmetic material is either closely spaced to the wiper lip 54 or comes into engagement with the wiper lip 54 such that the wiper lip flange 54 removes excess liquid cosmetic material therefrom and retains it within the chamber 14.

Although the inwardly directed flange 54 defining the wiper lip also defines the outermost aperture 50 of the first insert 44, extending to or even into the inner chamber 14, it will be appreciated that an inwardly directed flange or wiper lip could be disposed intermediate the ends of the first insert 44, so as to define a smaller aperture and a wiper lip for performing the same function of removing excess cosmetic material from the applicator wand 36, as described above.

Figure 4:
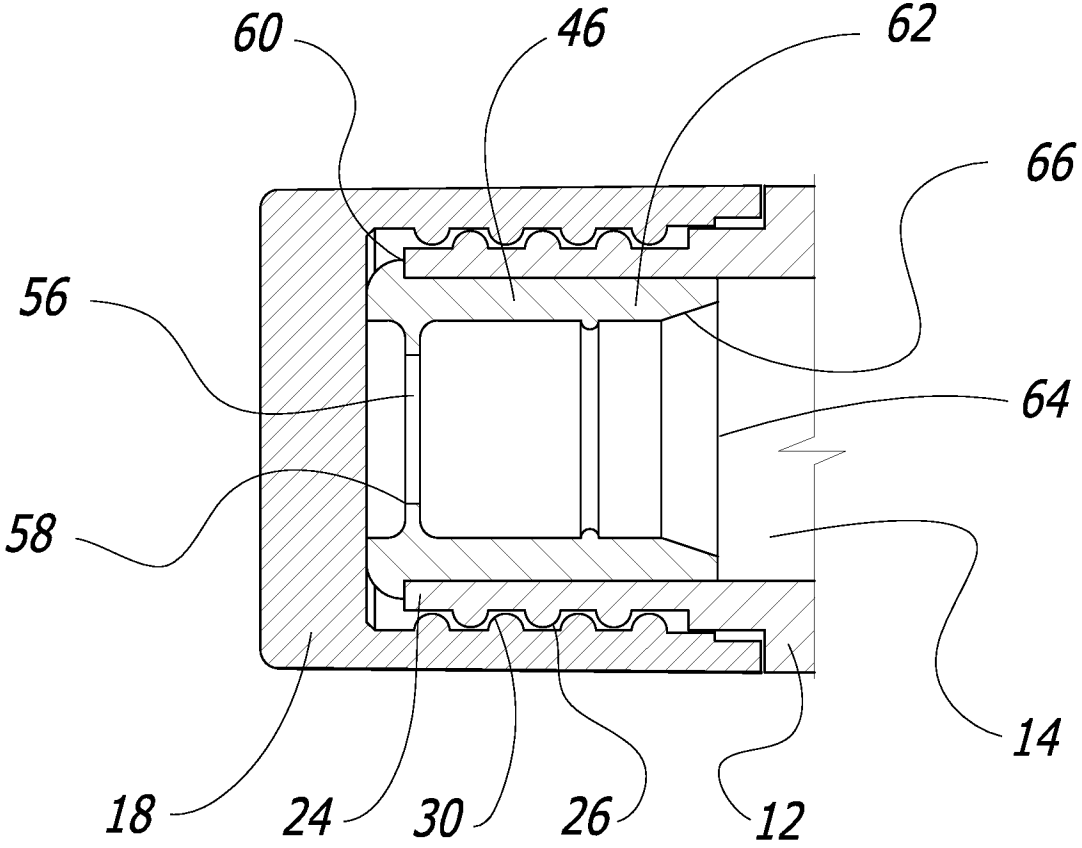
FIG. 4 is an enlarged cross-sectional view of area "4" of FIG. 2.
Figure 6:
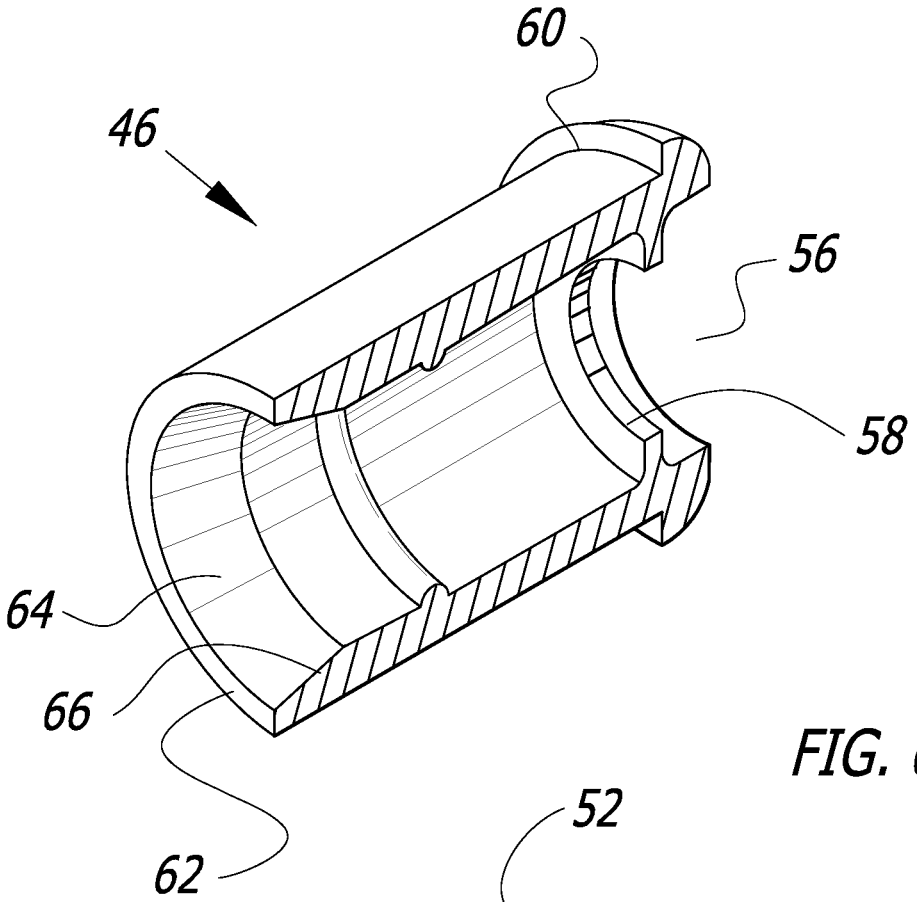
FIG. 6 is a cross-sectional view taken generally along line 6-6 of FIG. 3, illustrating a sectioned perspective view of a second insert used in accordance with the present invention.

With reference now to FIGS. 4 and 6, the second insert 46, as described above, is insertable into the second open end 24 of the body 12. It is also of a generally cylindrical, hollow configuration. The second insert 46 includes a first aperture 56 defined by an inwardly directed flange 58 forming a wiper lip 58. As illustrated in FIG. 4, this aperture 56 and wiper lip 58 are disposed proximal or adjacent to the end cap 18 and the second end 24 of the body 12. This is a preferred arrangement and configuration, although the inwardly directed flange 58 defining the relatively small diameter aperture 56 could be disposed interiorly of the end of the second insert 46.

Similar to the first insert 44, the second insert 46 includes a ledge 60 which rests against the outermost end of the second end 24 of the body 12, the remainder of the second insert 46 having an outer diameter which is substantially equal to or slightly less than the diameter of the portion of the body 12 and/or chamber 14 it is inserted into. A second end 62, generally opposite the ledge 60 and opening 56, is configured so as to direct and funnel the liquid cosmetic material into the second insert 46 when the second end of the container 24 is directed downwardly. This second end includes a second aperture 64, spaced apart and generally opposite the first aperture 56, and which has a greater diameter than the first aperture 56 defining the wiper lip 58. In one embodiment, the second end 62 has a bevel 66 or is flared such that the liquid cosmetic material is directed and funneled inwardly into the second insert 46.

The inwardly directed flanges or wiper lips 54 and 58 defining the smaller apertures 50 and 56 of the first and second inserts 44 and 46, respectively, create an aperture 50 and 56 which is selectively sized with respect to the applicator wand 36 so as to remove excess cosmetic fluid therefrom. The apertures 50 and 56 are typically slightly larger than the rod 40 of the applicator wand 36, so as to allow the applicator wand 36 to be slidably inserted therethrough with relative ease. However, the end tip 42 of the applicator wand 36, which includes the brush or other cosmetic capturing material, is slightly smaller, approximately the same size or only slightly larger in diameter than the diameter of the apertures 50 and 56 defining the wiper lips 54 and 58. In this manner, when the end or tip 42 of the applicator wand 36 is moved through the aperture 50 or 56, the wiper lip 54 and 58 serves to prevent excess cosmetic material to pass through the aperture 50 or 56. Typically, the wiper lip 54 or 58 will contact an outer surface of the applicator wand tip or end 42 to accomplish this objective.

The relatively small diameter of the aperture 50 or 56, defining the wiper lip 54 or 58, also acts as a stopper by discouraging the liquid cosmetic material from flowing therethrough. This is particularly the case when the applicator wand 36 is inserted therethrough as there is a relatively small space between the rod 40 and the wiper lip 54 or 58, as illustrated in FIG. 2. In the case of the first insert 44, the wiper lip 54, and the corresponding aperture 50 is typically at a distal or far end of the insert 44, so as to be adjacent to or reside within the chamber 14 of the body 12. However, the inwardly directed flange defining the wiper lip 54 and the aperture 50 can be positioned at any convenient location along the length of the insert 44.

However, in the case of the second insert 46, the distal or far second end 62 of the insert 46 cannot have the wiper lip 58 disposed at that end 62. Instead, the second insert 46 has the far second end 62 defining a relatively large aperture 64 with a flared out or beveled inner surface 66 so as to act as a funnel, and direct the liquid cosmetic material into the hollow body of the second insert 46. Thus, the inwardly directed flange defining the wiper blade 58 and the smaller aperture 56 must be spaced from the second end 62, and is preferably formed towards the first end defined by ledge 60, as illustrated in FIG. 6, such that the funneling of the liquid cosmetic material into the second insert 46 can be maximized.

In use, the first end cap 16 is removed from the first end 20 of the body 12, and the attached applicator wand 36 is removed through the first insert 44, removing excess cosmetic material therefrom, and allowing the individual to apply the cosmetic material to the individual's eyelashes, eyebrows, lips, or whichever body part the cosmetic is intended for. This is repeatedly done over time until the level of the liquid cosmetic material within the container 12 becomes low. At that point, the first end cap 16 and applicator wand 36 are removed from the first end 20 of the body 12. The second end cap 18 is removed from the second end 24 of the body 12, and attached to the first end 20 of the body 12. The applicator wand 36 is inserted through the second insert 46 and second open end 34 of the body 12, and the first end cap 16 may be removably attached to the second end 24 of the body 12. With the second end 24 of the body 12 directed downwardly, the first end cap 16 and applicator wand 36 are withdrawn from the second end of the body 24, and thus through the second insert 46, which has funneled and collected the liquid cosmetic material therein, causing the tip 42 of the applicator wand 36 to become immersed in the liquid and capture it. Excess cosmetic material is scraped off by the second insert 46, as described above, and the individual can continue to use the container and remove the liquid cosmetic material from the second end 24 of the body 12 until the liquid cosmetic material is exhausted or only a very small amount of liquid cosmetic material remains within the container. In this manner, all, or nearly all, of the liquid cosmetic material within the chamber 14 of the body 12 and container 10 is captured and used by the individual.

Although several embodiments have been described in detail for purposes of illustration, various modifications may be made without departing from the scope and spirit of the invention. Accordingly, the invention is not to be limited, except as by the appended claims.

What is claimed is:

1. A cosmetic apparatus, comprising:

an elongated body defining a single chamber for storing liquid cosmetic material between a first open end and a second open end generally opposite the first open end, the chamber being accessible from either the first open end or the second open end;

a first cap removably attachable to either the first or second open end of the body;

a second cap removably attachable to either the first or second open end of the body;

an applicator wand extending into the chamber from either the first or second open end of the body and adapted to remove liquid cosmetic material from the chamber;

a first insert disposed within the first open end of the body, the first insert adapted to permit the applicator wand to slidably extend therethrough and scrape excess cosmetic material therefrom when removed from the body; and a second insert disposed within the second open end of the body, the second insert adapted to permit the applicator wand to slidably extend therethrough and scrape excess cosmetic material therefrom when removed from the body;

wherein the first cap is attached to an end of the applicator wand and serves as a handle for the applicator wand;

wherein the apparatus includes only a single applicator wand and the second cap is not attached to the applicator wand.

2. The cosmetic apparatus of claim 1, wherein the body adjacent to the first and second open ends includes external threads and the first and second caps include mating internal threads.

3. The cosmetic apparatus of claim 1, wherein the chamber has an elongated tubular configuration of a length greater than a length of the applicator wand disposable in the chamber.

4. The cosmetic apparatus of claim 1, wherein the first cap has a greater length than the second cap.

5. The cosmetic apparatus of claim 1, wherein an end of the applicator wand distal the first cap includes a liquid cosmetic capturing material.

6. The cosmetic apparatus of claim 5, wherein the distal end of the applicator wand comprises a brush or sponge material.

7. The cosmetic apparatus of claim 1, wherein the first insert is a generally hollow cylindrical member and includes a first aperture proximal the first open end and a wiper lip for scraping excess cosmetic material from the applicator wand.

8. The cosmetic apparatus of claim 7, wherein the first insert includes a second smaller aperture distal the first open end of the body and defining the wiper lip.

9. The cosmetic apparatus of claim 1, wherein the second insert is a generally hollow cylindrical member and includes a wiper lip for scraping excess cosmetic material from the applicator wand and an end configured to funnel cosmetic material from the chamber into the second insert when the second end of the apparatus is directed downwardly.

10. The cosmetic apparatus of claim 9, wherein the wiper lip of the second insert is defined by a first aperture and wherein the end configured to funnel cosmetic material is defined by a second aperture of a larger diameter than the first aperture and disposed adjacent to or within the chamber.

11. A cosmetic apparatus, comprising:

an elongated body defining a single chamber for storing liquid cosmetic material between a first open end and a second open end generally opposite the first open end, the chamber being accessible from either the first open end or the second open end;

an applicator wand extending into the chamber from either the first or second open end of the body and having an end comprising a liquid cosmetic capturing material adapted to remove liquid cosmetic material from the chamber;

a first cap attached to the applicator wand and serving as a handle for the applicator wand, the first cap being removably attachable to either the first or second open end of the body;

a second cap removably attachable to either the first or second open end of the body;

a first insert disposed within the first open end of the body, the first insert adapted to permit the applicator wand to slidably extend therethrough and scrape excess cosmetic material therefrom when removed from the body; and a second insert disposed within the second open end of the body, the second insert adapted to permit the applicator wand to slidably extend therethrough and scrape excess cosmetic material therefrom when removed from the body;

wherein the chamber has an elongated tubular configuration of a length greater than a length of the applicator wand disposable in the chamber;

wherein the second insert is a generally hollow cylindrical member and includes a wiper lip for scraping excess cosmetic material from the applicator wand and an end configured to funnel cosmetic material from the chamber into the second insert when the second end of the apparatus is directed downwardly; and wherein the wiper lip of the second insert is defined by a first aperture and wherein the end configured to funnel cosmetic material is defined by a second aperture of a larger diameter than the first aperture and disposed adjacent to or within the chamber.

12. The cosmetic apparatus of claim 11, wherein the body adjacent to the first and second open ends includes external threads and the first and second caps include mating internal threads.

13. The cosmetic apparatus of claim 11, wherein the apparatus includes only a single applicator wand and the second cap is not attached to the applicator wand.

14. The cosmetic apparatus of claim 11, wherein the distal end of the applicator wand comprises a brush or sponge material.

15. The cosmetic apparatus of claim 11, wherein the first insert is a generally hollow cylindrical member and includes a first aperture proximal the first opening-open end and a wiper lip for scraping excess cosmetic material from the applicator wand.

16. The cosmetic apparatus of claim 15, wherein the first insert includes a second smaller aperture distal the first open end of the body and defining the wiper lip.

17. A cosmetic apparatus, comprising:

an elongated body defining a single chamber for storing liquid cosmetic material between a first open end and a second open end generally opposite the first open end, the chamber being accessible from either the first open end or the second open end;

a first cap removably attachable to either the first or second open end of the body;

a second cap removably attachable to either the first or second open end of the body;

an applicator wand extending into the chamber from either the first or second open end of the body and adapted to remove liquid cosmetic material from the chamber;

a first insert disposed within the first open end of the body, the first insert adapted to permit the applicator wand to slidably extend therethrough and having a wiper lip to scrape excess cosmetic material from the applicator wand when removed from the body; and a second insert disposed within the second open end of the body, the second insert adapted to permit the applicator wand to slidably extend therethrough and having a wiper lip to scrape excess cosmetic material from the applicator wand when removed from the body, an end of the second insert disposed adjacent to or within the chamber being configured to funnel cosmetic material from the chamber into the second insert when the second end of the apparatus is directed downwardly;

wherein the first cap is attached to an end of the applicator wand and serves as a handle for the applicator wand; and wherein the apparatus includes only a single applicator wand and the second cap is not attached to the applicator wand.

18. The cosmetic apparatus of claim 17, wherein the first insert comprises a generally hollow cylindrical member having an aperture defining the wiper lip.

19. The cosmetic apparatus of claim 17, wherein the second insert is a generally hollow cylindrical member and wherein the wiper lip of the second insert is defined by a first aperture and wherein the end configured to funnel cosmetic material is defined by a second aperture of a larger diameter than the first aperture.

20. The cosmetic apparatus of claim 17, wherein the body adjacent to the first and second open ends includes external threads and the first and second caps include mating internal threads.

21. The cosmetic apparatus of claim 17, wherein the chamber has an elongated tubular configuration of a length greater than a length of the applicator wand disposable in the chamber.

22. The cosmetic apparatus of claim 17, wherein the first cap has a greater length than the second cap.

23. The cosmetic apparatus of claim 17, wherein an end of the applicator wand distal the first cap includes a liquid cosmetic capturing material.

24. The cosmetic apparatus of claim 23, wherein the distal end of the applicator wand comprises a brush or sponge material.

25. A cosmetic apparatus, comprising:

an elongated body defining a single chamber for storing liquid cosmetic material between a first open end and a second open end generally opposite the first open end, the chamber being accessible from either the first open end or the second open end;

a first cap removably attachable to either the first or second open end of the body;

a second cap removably attachable to either the first or second open end of the body;

an applicator wand extending into the chamber from either the first or second open end of the body and adapted to remove liquid cosmetic material from the chamber;

a first insert disposed within the first open end of the body, the first insert adapted to permit the applicator wand to slidably extend therethrough and scrape excess cosmetic material therefrom when removed from the body; and a second insert disposed within the second open end of the body, the second insert adapted to permit the applicator wand to slidably extend therethrough and scrape excess cosmetic material therefrom when removed from the body;

wherein the second insert is a generally hollow cylindrical member and includes a wiper lip for scraping excess cosmetic material from the applicator wand and an end configured to funnel cosmetic material from the chamber into the second insert when the second end of the apparatus is directed downwardly; and wherein the wiper lip of the second insert is defined by a first aperture and wherein the end configured to funnel cosmetic material is defined by a second aperture of a larger diameter than the first aperture and disposed adjacent to or within the chamber.

26. The cosmetic apparatus of claim 25, wherein the body adjacent to the first and second open ends includes external threads and the first and second caps include mating internal threads.

27. The cosmetic apparatus of claim 25, wherein the chamber has an elongated tubular configuration of a length greater than a length of the applicator wand disposable in the chamber.

28. The cosmetic apparatus of claim 25, wherein the first cap is attached to an end of the applicator wand and serves as a handle for the applicator wand.

29. The cosmetic apparatus of claim 28, wherein the apparatus includes only a single applicator wand and the second cap is not attached to the applicator wand.

30. The cosmetic apparatus of claim 28, wherein the first cap has a greater length than the second cap.

31. The cosmetic apparatus of claim 28, wherein an end of the applicator wand distal the first cap includes a liquid cosmetic capturing material.

32. The cosmetic apparatus of claim 31, wherein the distal end of the applicator wand comprises a brush or sponge material.

33. The cosmetic apparatus of claim 25, wherein the first insert is a generally hollow cylindrical member and includes a first aperture proximal the first opening and a wiper lip for scraping excess cosmetic material from the applicator wand.

34. The cosmetic apparatus of claim 33, wherein the first insert includes a second smaller aperture distal the first opening of the body and defining the wiper lip.

* * * * *